US005084946A

United States Patent [19]

Lee

[11] Patent Number: 5,084,946

[45] Date of Patent: Feb. 4, 1992

[54] QUICK DISCONNECT CONNECTOR

[75] Inventor: David J. Lee, Carmel, Ind.

[73] Assignee: Indiana Mills & Manufacturing, Inc., Westfield, Ind.

[21] Appl. No.: 625,371

[22] Filed: Dec. 11, 1990

[51] Int. Cl.[5] ..... A44B 11/25

[52] U.S. Cl. ..... 24/625; 24/200; 24/615

[58] Field of Search ..... 24/625, 615, 616, 618, 24/681, 313, 453, 519, 585, 200, 196, 193, 163 K, 17 A, 68 CD; 70/459; 403/290

[56] References Cited

U.S. PATENT DOCUMENTS

| | | | |
|---|---|---|---|
| 280,846 | 7/1883 | Methot | 24/200 |
| 1,074,498 | 9/1913 | Elker | 24/200 |
| 1,194,630 | 8/1916 | Hogan | 24/200 |
| 4,012,155 | 3/1977 | Morris | 24/625 |
| 4,150,464 | 4/1979 | Tracy | 24/615 |
| 4,408,375 | 10/1983 | Skobel | 70/459 |
| 4,688,337 | 8/1987 | Dillner et al. | 24/616 |
| 4,825,515 | 5/1989 | Wolterstorff, Jr. | 24/625 |
| 4,831,694 | 5/1989 | Kong | 24/625 |
| 4,962,965 | 10/1990 | Glover | 24/625 |

*Primary Examiner*—Victor N. Sakran
*Attorney, Agent, or Firm*—Woodard, Emhardt, Naughton Moriarty & McNett

[57] ABSTRACT

A quick disconnect connector. A female member includes an outwardly opening cavity formed by four integrally formed sidwalls. A male member is insertable into the cavity and includes a pair of flexible spring biased arms releasably lockable and extendable into a pair of slots formed in the sidewalls of the female member. Ramps formed on the flexible arms are arranged relative to the slot edges to force the arms inwardly apart from the sidewalls to unlock therefrom when oppositely directed forces are applied to the opposite ends of the male member and female member. Cooperating guide means formed internally on the sidewalls and on a center post cantileveredly mounted to the male member guide the male member relative to the female member. Slots formed in the opposite ends of the male member and female member mountingly receive belts arranged perpendicularly to the longitudinal axis of the male member and female member.

12 Claims, 3 Drawing Sheets

QUICK DISCONNECT CONNECTOR

BACKGROUND OF THE INVENTION

1. Field of the Invention

This invention is in the field of connectors having a tongue releasably engageable with a buckle.

2. Description of the Prior Art

In U.S. Pat. No. 4,150,464 issued to Richard J. Tracy there is disclosed a connector having a tongue releasably engageable with a buckle for connecting together a pair of belts. The tongue includes a pair of flexible arms moveable inward against a center tongue post and then extendable into the buckle. Release of the arms force the distal ends of the arms to lockingly engage a pair of slots formed in the buckle. The tongue and buckle are locked together until the operators fingers are forced through the slots against the arms to move the arms inwardly.

In many cases, it is desirable to unlock a connector by simply pulling on the opposite ends of the connector as compared to pushing a button, pivoting a lever, or depressing arms together such as required by many of the prior buckle tongue combinations. Likewise, belt connectors are located in inconvenient locations or not readily visible thereby increasing the difficulty in unlocking the connector. Connectors utilized with infant or child seats may be relatively small in size as compared to conventional buckle tongue combinations and may not be readily visible since the infant or child may partially cover the connector. It is therefore desirable to provide a quick disconnect connector which may be unlocked by applying opposite force on the opposite ends of the tongue and buckle as contrasted to pivoting a lever or manually depressing arms together to unlock the connector. Disclosed herein is such a quick disconnect connector.

SUMMARY OF THE INVENTION

Figure 1:
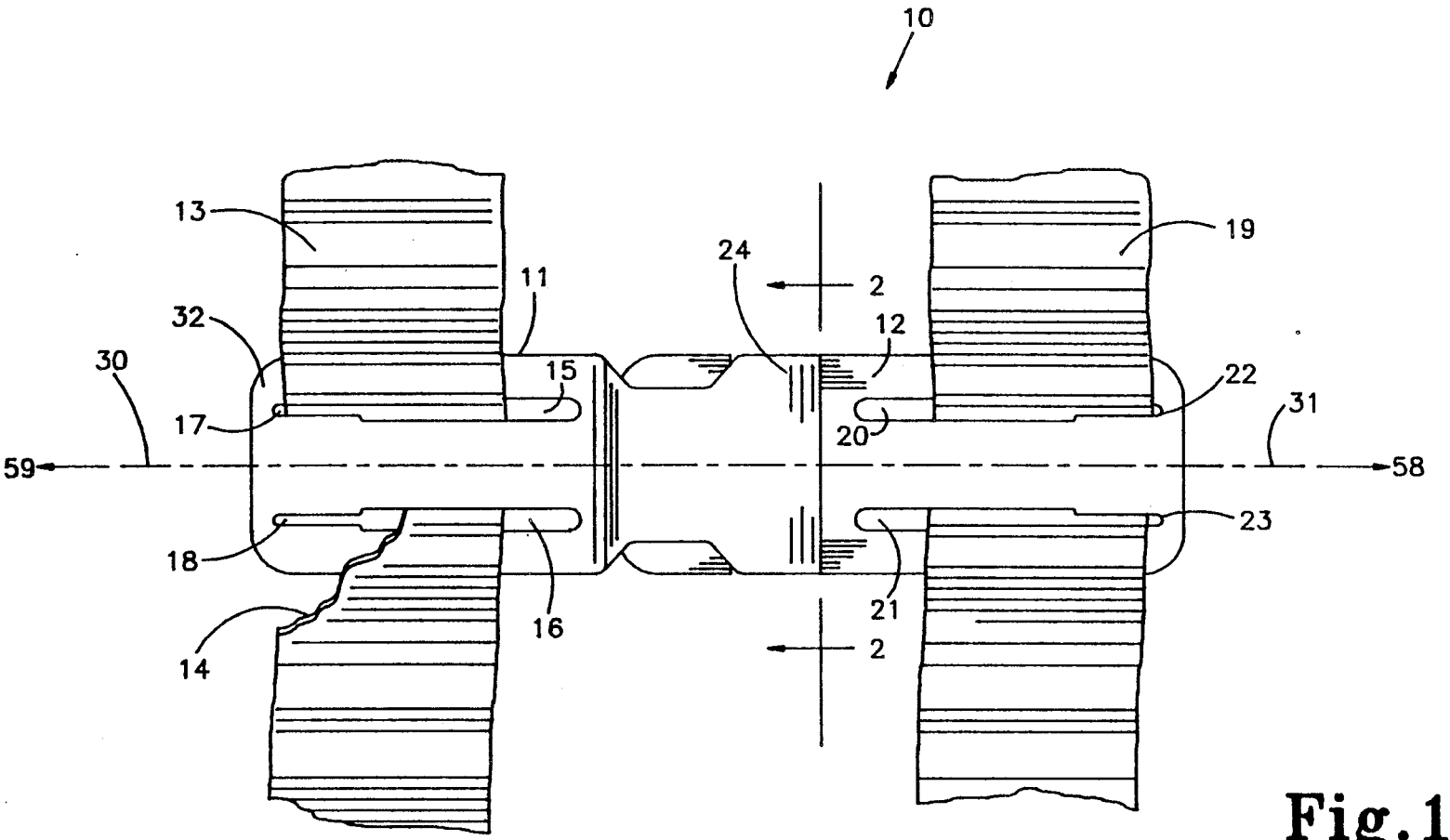
FIG. 1 is a plan view of the buckle tongue combination incorporating the present invention shown mounted to a pair of belts.

One embodiment of the present invention is a quick release connector comprising a female member having a female end and an opposite first web connecting end. The female end including a plurality of side walls defining an outwardly opening cavity. The side walls including guide means thereon and a pair of oppositely positioned reliefs located within the cavity defining a first pair of oppositely positioned ramps. The member further including a first longitudinal axis extending through the female end, the cavity, and the connecting end. The connector also comprising a male member having a male end and an opposite second web connecting end. The male member including a second longitudinal axis extending through the male end and the opposite second web connecting end and including a pair of cantileveredly mounted flexible arms and a cantileveredly mounted post spaced apart from but between the arms. The post cooperatively engageable with the guide means to cause the male member to move along the first longitudinal axis as the male member is inserted and withdrawn from the female member with the arms being flexible and movable from a normal spaced apart position whereat the arms lockingly engage the female end to an inwardly located release position whereat the arms converge, are unlocked and are movable outward apart from the female end. The post having a length in the direction of the second longitudinal axis less than the arms enabling the arms to contact together without contacting the post. The arms including a second pair of ramps facing outwardly and engageable with the first pair of ramps when the arms are in the cavity and are lockingly engaged with the female end. The first pair of ramps and the second pair of ramps configured to hold the male member locked to the female member until external force above a predetermined amount is applied to the female member only along the first longitudinal axis and to the male member only along the second longitudinal axis.

It is an object of the present invention to provide a quick disconnect connector which is unlockable by pulling on the opposite ends thereof.

A further object of the present invention is to provide a quick release connector operable to hold a pair of parallel belts apart.

An additional object of the present invention is to provide a new and improved connector.

Related object and advantages of the present invention will be apparent from the following description.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a quick release or quick disconnect connector 10 incorporating the present invention. Connector 10 includes a female member or buckle 11 releasably engageable with a male member or tongue 12. Female member 11 includes a pair of slots 15 and 16 parallel to the longitudinal axis 30 extending centrally through the buckle. A belt 13 extends through slots 15 and 16 each having a slot width of approximately 0.15 inches with the belt having an approximate thickness of 0.05 inches allowing the belt to be adjusted. Belt 13 is fragmented at location 14 to illustrate slot 16 which is identical to slot 15.

A second belt 19 parallel to belt 13 extends through slots 20 and 21 of the male member or tongue 12. Slots 20 and 21 are identical to slots 15 and 16 in that the slot width is greater than the thickness of belt 19 allowing the belt to be adjusted. Tongue 12 includes a longitudinal axis 31 which extends centrally through the tongue being parallel to slots 20 and 21 and coincident with axis 30. Belts 13 and 19 are arranged perpendicular relative to axes 30 and 31.

Figure 2:
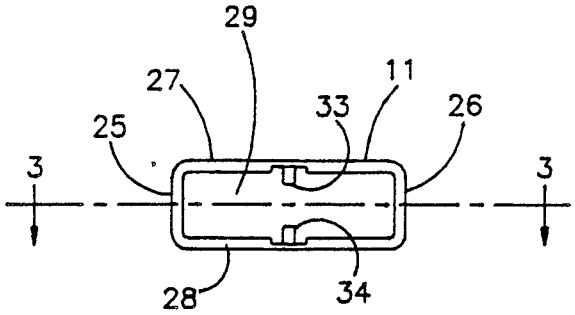
FIG. 2 is an end view of the buckle or female portion of the connector looking in the direction of arrows 2—2 of FIG. 1.

Female member 11 has a female end 24 and an opposite belt connecting end 32. Female end 24 is formed by four side walls 25 through 28 (FIG. 2) integrally joined together forming a rectangular cavity 29 opening toward the male member 12. Sidewalls 27 and 28 include a pair of mutually opposed and inwardly extending rails 33 and 34 forming a guide means for the purpose of guiding the male member into the female member. Each rail 33 and 34 includes a pair of parallel grooves formed on either side and extending the length of each rail.

Figure 3:
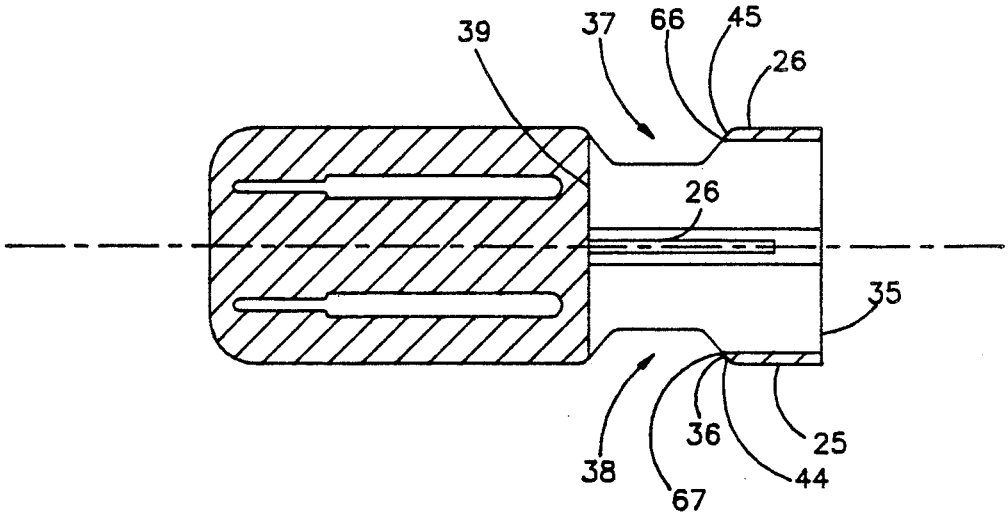
FIG. 3 is a cross sectional view taken along a line and viewed in the direction of arrows 3—3 of FIG. 2.

Sidewalls 25 and 26 extend from the open end or distal edge 35 rearwardly to location 36 (FIG. 3) terminating thereat and forming a pair of reliefs or openings 37 and 38. Sidewalls 27 and 28 extend from edge 35 to location 39 where the remaining portion of the buckle extends as a solid toward the aft end of the buckle having slots 15 and 16 formed therein.

Figure 4:
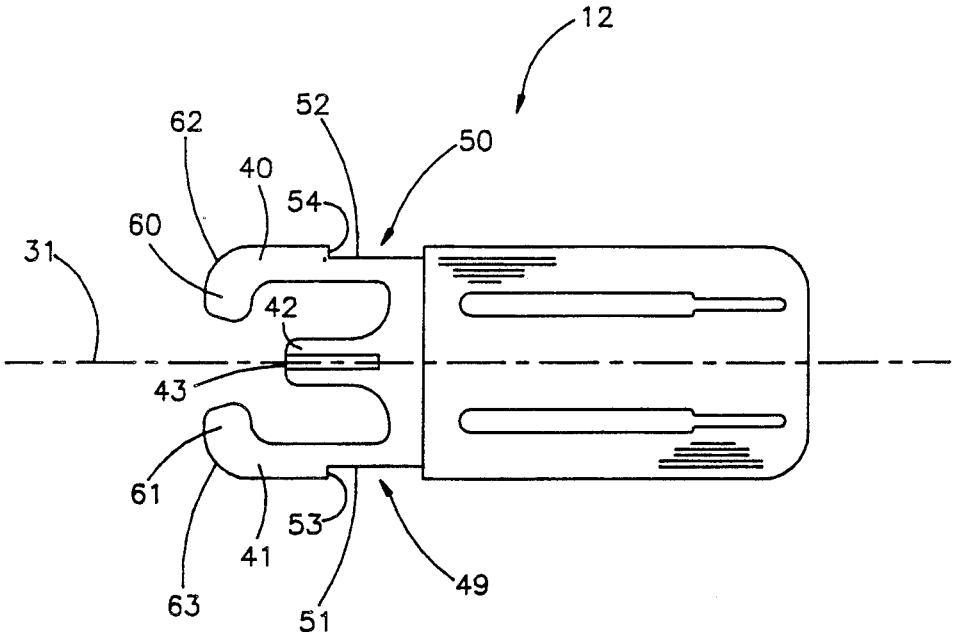
FIG. 4 is a plan view of the tongue or male portion of the combination shown in FIG. 1.

Male member 12 (FIG. 4) includes a pair of cantileveredly mounted flexible arms 40 and 41 and a cantileveredly mounted post 42 spaced apart from but between the arms. Post 42 has a pair of parallel slots extending on the opposite side thereof along longitudinal axis 31 with one such slot 43 being shown in FIG. 4. Slot 43 slidable engages rail 33 with the opposite slot engaging rail 34 as the tongue is longitudinally moved relative to the buckle. The slots formed in post 42 are cooperatively engageable with the rails 33 and 34 providing a guide means to cause the male member to move along longitudinal axis 30 as the male member is inserted and withdrawn from the female member. Male member 12 may be produced from plastic enabling arms 40 and 41 to be flexible and allowing the arms to move from a normal spaced apart position shown in FIG. 4 whereat the arms lockingly engage the female end of the buckle, to an inwardly located release position whereat the arms converge, are unlocked and move along with the tongue along longitudinal axis 30 apart from the female end. Notably, post 43 has a length along axis 31 less than the length of arms 40 and 41 enabling the arms to contact together without contacting the post. The male member and female member are unlocked by applying opposite forces to the belt engaging ends of the tongue and buckle. It is desirable that arms 40 and 41 be freely moveable together when such force is applied without contacting the post so that the male member is not impeded as it is withdrawn from the female member.

Figure 5:
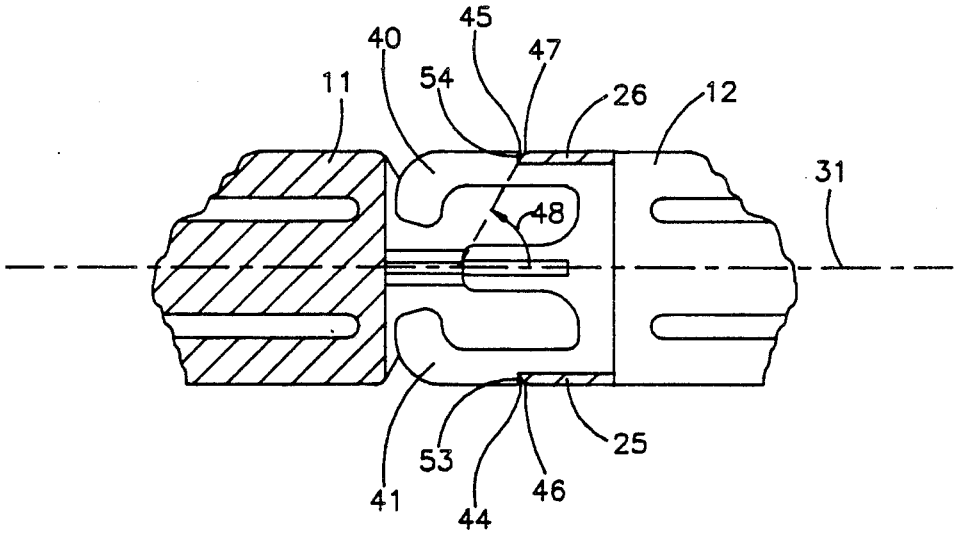
FIG. 5 is an enlarged cross sectional fragmentary view of the buckle tongue combination of FIG. 1.

The aft end of walls 25 and 26 (FIG. 5) include a straight or flat surface 44 and 45 arranged at an acute angle 48 relative to longitudinal axis 31. In one embodiment, acute angle 48 is approximately 60 degrees. The outer edge 46 and 47 of surfaces 44 and 45 is radiused whereas the inner edges 66 and 67 (FIG. 3) of surfaces 44 and 45 are each a sharp edge.

Arms 40 and 41 have a recess step 49 and 50 (FIG. 4) complimentary is size to receive respectively walls 25 and 26 when the male member is inserted and locked to the female member. Steps 49 and 50 include parallel flat surfaces 51 and 52 in turn extending parallel to axis 31. The arms are normally spaced apart when the male member is inserted in the female member so that sidewalls 25 and 26 are positioned within steps 49 and 50.

Surfaces 53 and 54 extend perpendicular from surfaces 51 and 52 and axis 31 forming a pair of ramps which are slidably moveable on edges 66 and 67 allowing the arms to move together as withdrawal force is applied to the opposite ends of the male and female member. Most importantly, surfaces 53 and 54 extend rearwardly toward the belt engaging end of the male member enabling the ramp surfaces 53 and 54 to contact and slide along edges 66 and 67. Edges 66 and 67 contact surfaces 53 and 54 along a line and thus only a small portion of surfaces 53 and 54 contact edges 66 and 67 at a given time. Surfaces 53 and 54 and edges 66 and 67 are contactable together to hold the male member locked to the female member until external force above a pre-determined amount is applied to male member 12 along axis 31 in the direction of arrow 58 and to female member 11 along axis 30 in the direction of arrow 59 (FIG. 1) and without requiring the user to force his/her fingers through openings 37 and 38 to pinch arms 40 and 41 together. In one embodiment, surfaces 53 and 54 were arranged so that the pre-determined amount of external force applied to the male and female member to unlock same was approximately fifteen pounds. That is, a total of fifteen pounds was applied to the male member in the direction of arrow 58 while holding the female member fixed or a total of fifteen pounds of external force was applied in the direction of arrow 59 to the female member while holding the male member fixed.

Arms 40 and 41 (FIG. 4) include inwardly turned distal ends 60 and 61 which are contactable together as the arms are moved to the unlocked position. The distal ends of the arms limit the amount inward movement of the arms; however, arms 60 and 61 do not contact post 42. As a result, the male member may be quickly and easily withdrawn from the female member without the distal ends of the arms contacting post 42. The outwardly facing surface 62 of distal end 60 and surface 63 of distal end 61 are radiused and contact the interior surface of sidewalls 25 and 26 (FIG. 3) causing the arms to pivot inwardly as the male member is inserted into the female member.

While the invention has been illustrated and described in detail in the drawings and foregoing description, the same is to be considered as illustrative and not restrictive in character, it being understood that all changes and modifications that come within the spirit of the invention are desired to be protected.

What is claimed is:

1. A quick release connector comprising:

a female member having a female end and an opposite first web connecting end, said female end including a plurality of side walls defining an outwardly opening cavity, said side walls including guide means thereon and a pair of oppositely positioned reliefs located within said cavity and defining a first pair of ramp means, said member further including a first longitudinal axis extending through said female end, said cavity, and said connecting end; and, a male member having a male end and an opposite second web connecting end, said male member including a second longitudinal axis extending through said male end and said opposite second web connecting end, said male end including a pair of cantileveredly mounted flexible arms and a cantileveredly mounted post spaced apart from but between said arms with said post cooperatively engageable with said guide means to cause said male member to move along said first longitudinal axis as said male member is inserted and withdrawn from said female member, said arms being flexible and movable from a normal spaced apart position whereat said arms lockingly engage said female end to an inwardly located release position whereat said arms converge, are unlocked and are movable outward apart from said female end, said post having a length in the direction of said second longitudinal axis less than said arms enabling said arms to contact together without contacting said post, said arms including a second pair of ramp means facing outwardly and engageable with said first pair of ramp means when said arms are in said cavity and are lockingly engaged with said female end, said first pair of ramp means and said second pair of ramp means being configured to hold said male member locked to said female member until external force above a predetermined amount is applied to said female member only along said first longitudinal axis and to said male member only along said second longitudinal axis.

2. The connector of claim 1 wherein:

said arms include inwardly turned distal ends contactable together to limit inward movement of said arms, said distal ends each include an end radiused surface contactable against said side walls defining said cavity causing said arms to pivot inwardly as said male member is inserted into said female member.

3. The connector of claim 2 wherein:

said arms each include recesses forming outwardly facing flat surfaces parallel to said second longitudinal axis located adjacent and aft of said distal ends, said second pair of ramp means are contact surfaces extending in a direction perpendicular from said flat surfaces;

said reliefs in said side walls form said first pair of ramp means which include a pair of edges and ramp surfaces facing toward said first web connecting end with said edges contacting said contact surfaces when said male member is inserted and locked with said female member, said ramp surfaces extending at an acute angle relative to said second longitudinal axis defining said edges as sharp to normally retain said contact surfaces on said edges but allowing said contact surfaces to move on said edges disengaging said male member from said female member when said predetermined amount of force is applied.

4. The connector of claim 3 wherein:

said first web connecting end and said second web connecting end include respectively a first pair of slots and a second pair of slots extending parallel respectively to said first longitudinal axis and said second longitudinal axis allowing a first web to be extended through said first pair of slots and a second web to be extended through said second pair of slots perpendicular respectively to said first longitudinal axis and said second longitudinal axis with said male member and said female member when engaged keeping said first web and said second web spaced apart a constant distance.

5. The connector of claim 4 wherein:

said post has a post proximal end cantileveredly mounted to said male member and has a post distal end, said post further includes a side with a first channel thereon extending in the direction of said second longitudinal axis and an opposite side with a second channel thereon extending in the direction of said second longitudinal axis;

said female member including a first ridge formed internally on a first one of said side walls and a second ridge formed internally on a second one of said side walls opposite of said first one, said first ridge and said second ridge extending in the direction of said first longitudinal axis, said first channel and said second channel slidably receiving respectively said ridge and said second ridge directing said male member into said female member.

6. The connector of claim 3 wherein:

said predetermined amount of said external force is approximately fifteen pounds.

7. A quick disconnect connector comprising:

a female member having a female end including a plurality of side walls defining an outwardly opening cavity, said side walls including a pair of oppositely positioned reliefs defining a first pair of oppositely positioned ramp means, said member further including a first longitudinal axis extending through said female end and said cavity; and, a male member having a male end including a second longitudinal axis extending through said male end and including a pair of cantileveredly mounted flexible arms movable from a normal spaced apart position whereat said arms lockingly engage said female end to an inwardly located release position whereat said arms converge, are unlocked and are movable outward apart from said female end, said arms including a second pair of ramp means engageable with said first pair of ramp means when said arms are in said cavity and are lockingly engaged with said female end, said first pair of ramp means and said second pair of ramp means being arranged to hold said male member locked to said female member until external force above a predetermined amount is applied to said female member only along said first longitudinal axis and to said male member only along said second longitudinal axis.

8. The connector of claim 7 wherein:

said arms each include recesses forming outwardly facing flat surfaces parallel to said second longitudinal axis, said second pair of ramp means are contact surfaces extending from said flat surfaces;

said reliefs in said side walls form said first pair of ramp means which include a pair of edges and ramp surfaces arranged to contact said contact surfaces when said male member is inserted and locked with said female member, said ramp surfaces extending at an acute angle relative to said second longitudinal axis so said edges are normally retained on said contact surfaces but allowing said contact surfaces to move on said edges disengaging said male member from said female member when said predetermined amount of force is applied.

9. The connector of claim 8 wherein:

said ramp surfaces each including a straight surface arranged at said acute angle and an outer radiused surface extending from said straight surface toward said female end.

10. A quick disconnect connector belt combination:

a first belt;

a second belt;

a female member having a first end mounted to said first belt and having an opposite female end including guide means thereon and a plurality of side walls defining an outwardly opening cavity, said side walls including a pair of oppositely positioned reliefs located within said cavity and defining a pair of oppositely positioned sharp edges, said member further including a first longitudinal axis extending through said female end and said cavity; and, a male member having a second end mounted to said second belt and having an opposite male end including a second longitudinal axis extending through said male end and including a pair of cantileveredly mounted flexible arms movable from a normal spaced apart position whereat said arms lockingly engage said female end spacing said first belt and said second belt apart to an inwardly located release position whereat said arms converge, are unlocked and are movable outward apart from said female end, said male member further having a cantileveredly mounted post spaced apart from but between said arms with said post cooperatively engageable with said guide means to cause said male member to move along said first longitudinal axis as said male member is inserted and withdrawn from said female member, said post having a length in the direction of said second longitudinal axis less than said arms enabling said arms to contact together without contacting said post, said arms including a pair of ramps and contactable against said pair of sharp edges when said arms are in said cavity and are lockingly engaged with said female end, said pair of sharp edges and said pair of ramps holding said male member locked to said female member until external force above a predetermined amount is applied to said female member only along said first longitudinal axis and to said male member only along said second longitudinal axis.

11. The connector of claim 10 wherein:

said first end and said second end include respectively a first pair of slots and a second pair of slots extending parallel respectively to said first longitudinal axis and said second longitudinal axis allowing said first belt to be extended through said first pair of slots and a second belt to be extended through said second pair of slots perpendicular respectively to said first longitudinal axis and said second longitudinal axis with said male member and said female member when engaged keeping said first belt and said second belt spaced apart a constant distance.

12. The connector of claim 11 wherein:

said side walls have mutually facing inwardly located surfaces with said sharp edges located immediately adjacent said inwardly located surfaces.

* * * * *